US005450166A

United States Patent [19]

Yashiro

[11] Patent Number: 5,450,166

[45] Date of Patent: Sep. 12, 1995

[54] PROCESS CARTRIDGE, RECORDING APPARATUS, AND METHOD FOR ASSEMBLING PROCESS CARTRIDGE

[75] Inventor: Masahiko Yashiro, Yokohama, Japan

[73] Assignee: Canon Kabushiki Kaisha, Tokyo, Japan

[21] Appl. No.: 949,866

[22] PCT Filed: Apr. 10, 1992

[86] PCT No.: PCT/JP92/00450

§ 371 Date: Nov. 23, 1992

§ 102(e) Date: Nov. 23, 1992

[87] PCT Pub. No.: WO92/18910

PCT Pub. Date: Oct. 29, 1992

[30] Foreign Application Priority Data

Apr. 10, 1991 [JP] Japan ..... 3-77606

[51] Int. Cl.[6] ..... G03G 21/18

[52] U.S. Cl. ..... 355/210

[58] Field of Search ..... 355/200, 210, 211, 245, 355/260

[56] References Cited

U.S. PATENT DOCUMENTS

| | | | |
|---|---|---|---|
| 4,866,482 | 9/1989 | Hirasawa et al. | 355/260 |
| 5,028,966 | 7/1991 | Kozuka et al. | 355/210 X |
| 5,061,959 | 10/1991 | Kinoshita et al. | 355/210 |
| 5,115,272 | 5/1992 | Ohmori et al. | 355/200 |
| 5,153,649 | 10/1992 | Park | 355/260 |

FOREIGN PATENT DOCUMENTS

| | | | |
|---|---|---|---|
| 0329145 | 8/1989 | European Pat. Off. . | |
| 0405514 | 1/1991 | European Pat. Off. . | |
| 3907875 | 9/1989 | Germany . | |
| 60-168175 | 8/1985 | Japan . | |
| 61-279870 | 12/1986 | Japan . | |
| 1-244472 | 9/1989 | Japan . | |
| 3-15864 | 1/1991 | Japan | 355/210 |

*Primary Examiner*—Joan H. Pendegrass

*Attorney, Agent, or Firm*—Fitzpatrick, Cella, Harper & Scinto

[57] ABSTRACT

The present invention realizes to shorten the assembling process of a process cartridge, by employing a first support member supporting an image bearing member, a second support member supporting a development unit for acting on the image bearing member to thereby develope an image of the image bearing member, a defining member for defining the rotary shaft between the first and second support members, and a compression spring for generating an elastic force between the image bearing member and the development unit.

76 Claims, 8 Drawing Sheets

100
100a
107
107a
107b
107d
107e
107e1
107e2
107e3
104
106
106a
106b
106d
106e
200
200a
200b
250
123
123a
123b
123c
124
305
B
C

PROCESS CARTRIDGE, RECORDING APPARATUS, AND METHOD FOR ASSEMBLING PROCESS CARTRIDGE

FIELD OF THE INVENTION

The present invention relates to a process cartridge, a recording apparatus and a method for assembling a process cartridge.

The process cartridge means an integral unit including at least an image bearing member (for example an electrophotographic photosensitive member) and developing means, rendered attachable to and detachable from a recording apparatus.

The recording apparatus can be, for example, an electrophotographic copying apparatus, a laser beam printer (LBP), a facsimile apparatus, a word processor or the like.

DESCRIPTION OF THE RELATED ART

In the following there will be explained the background art of the present invention.

FIGS. 1(*a*) and 1(*b*) are views showing the background art of the present invention, wherein FIG. 1(*a*) is a schematic lateral cross-sectional view of a process cartridge not mounted on the recording apparatus, and FIG. 1(*b*) is a perspective view in which the process cartridge is divided into a developing unit and a cleaner unit.

As shown in FIGS. 1(*a*) and 1(*b*), a photosensitive drum unit 7 is provided with a photosensitive drum 4, and a cleaning blade 7*a* and a used toner reservoir 7*b* constituting a cleaner 7*e* for cleaning the periphery of said photosensitive drum 4.

Also a developing unit 6 is provided with a developing sleeve 6*a* and a toner reservoir 6*b* constituting a developer 6*i*. (In these drawings, the toner in the toner reservoir 6*b* and in the used toner reservoir 7*b* is omitted.)

Pins 6*d* formed on arms 6*c* of the unit 6 are fitted in holes 7*c* of the unit 7, and are then prevented from displacement in the thrust direction by a thrust stopper 6*f* such as a ring, fitted on a groove 6*e* of the pin 6*d*. Thus the units 6, 7 are mutually rotatable about said pins 6*d*. Subsequently tension springs 9 are applied between pins 6*g* provided on both sides of the unit 6 and pins 7*d* provided on both sides of the unit 7, thereby generating a tensile force between the units 6 and 7. Thus the units 6, 7 are integrated in a state in which the photosensitive drum 4 and the developing sleeve 6*a* are mutually contacted with a predetermined pressure in a direction A.

When the process cartridge 1 is mounted on a laser beam printer (not shown), the photosensitive drum 4 is driven by a driving gear (not shown) of the main body of the apparatus, while the developing sleeve 6*a* is rotated by a developing roller gear 6*h* meshing with a photosensitive drum gear 4*a*. In general, the pins 6*d* and the holes 7*c* are positioned in the angular direction of meshing pressure of said gears, in order not to receive the force in the rotational direction.

However, the above-explained process cartridge requires a cumbersome operation in the assembling, as the tension springs 9 cannot be placed between the pins 6*g* and 7*d* unless they are once extended with a force exceeding the necessary tensile force. Also in case of disassembling the process cartridge into the cleaner 7 and the developer unit 6 for maintenance or the like, there have to be detached the springs 9 and then the thrust stopper 6*f*. In this manner cumbersome operations are involved in the assembling and disassembling of such conventional process cartridge.

On the other hand, the present applicant made an invention enabling the process cartridge to be made compact by the use of compression coil springs in contacting the developing sleeve with the photosensitive drum with a predetermined pressure, and applied for a patent in Japan on this invention (Japanese Patent Application No. 63-69735, filed Mar. 25, 1988; Japanese Patent Laid-open Application No. 1-244472, laid open Sep. 28, 1989).

The present invention is an extension of the above-mentioned background art and of the above-explained invention of the present applicant.

SUMMARY OF THE INVENTION

An object of the present invention is to provide a process cartridge enabling further compactization, an image forming apparatus adapted therefor, and a method for assembling such process cartridge.

Another object of the present invention is to provide a process cartridge capable of reducing the assembling process, an image forming apparatus adapted therefor, and a method for assembling such process cartridge.

Still another object of the present invention is to provide a process cartridge capable of reducing the disassembling process, an image forming apparatus adapted therefor, and a method for assembling such process cartridge.

Still another object of the present invention is to provide a process cartridge with improved assembling and disassembling property, an image forming apparatus adapted therefor, and a method of assembling such process cartridge.

In a principal aspect of the present invention, there is provided a process cartridge capable of being attached to and detached from a recording apparatus, comprising a first support member supporting an image bearing member, a second support member supporting developing means for acting on the image bearing member thereby developing an image on the image bearing member, and coupling means including a limiting member for limiting rotary axis between the first and second support members and a compression spring for generating an elastic force between the image bearing member and the developing means, thereby being used for coupling the first and second support members.

In another principal aspect of the present invention, there is provided a recording apparatus for effecting a recording operation on a recording medium, comprising mounting means for mounting a process cartridge including a first support member supporting an image bearing member, a second support member supporting developing means for acting on the image bearing member thereby developing an image on the image bearing member, and coupling means including a limiting member for limiting the rotary axis between the first and second support members and a compression spring for generating an elastic force between the image bearing member and the developing means, thereby being used for coupling the first and second support members; and transport means for transporting the recording medium.

In still another principal aspect of the present invention, there is provided a method for assembling a process cartridge including a first support member supporting an image bearing member, a second support member supporting developing means for acting on the image bearing member thereby developing an image on the image bearing member, and coupling means including a limiting member for limiting the rotary axis between the first and second support members and a compression spring for generating an elastic force between the image bearing member and the developing means, thereby being used for coupling the first and second support members, the method comprising a step of integrally coupling the first and second support members in a mutually rotatable manner about the rotary axis by means of the coupling means.

In still another principal aspect of the present invention, there is provided a process cartridge capable of being attached to and detached from a recording apparatus, comprising, a first frame supporting an image bearing member, and a second frame supporting developing means for acting on the image bearing member thereby developing an image on the image bearing member, wherein the first and second frames mutually cooperate to form an aperture when they are coupled.

Owing to the above-mentioned characteristic configurations, the present invention achieves simplification of the assembling process of the process cartridge, since, because of said characteristic configurations, the present invention allows assembly of the process cartridge without the use of a tension spring. Also because of said characteristic configurations, the present invention allows mounting of the compression spring in an easy manner during the assembly of the process cartridge.

Also owing to said characteristic configurations, the present invention allows formation of an aperture (for example an aperture for exposure) without sacrificing the strength of the casing of the process cartridge. Because of said characteristic configurations, the present invention allows formation of to form the aperture, without forming a hole in the casing.

DESCRIPTION OF THE PREFERRED EMBODIMENTS

Now the present invention will be clarified in detail by preferred embodiments thereof shown in the accompanying drawings.

Figure 1B:
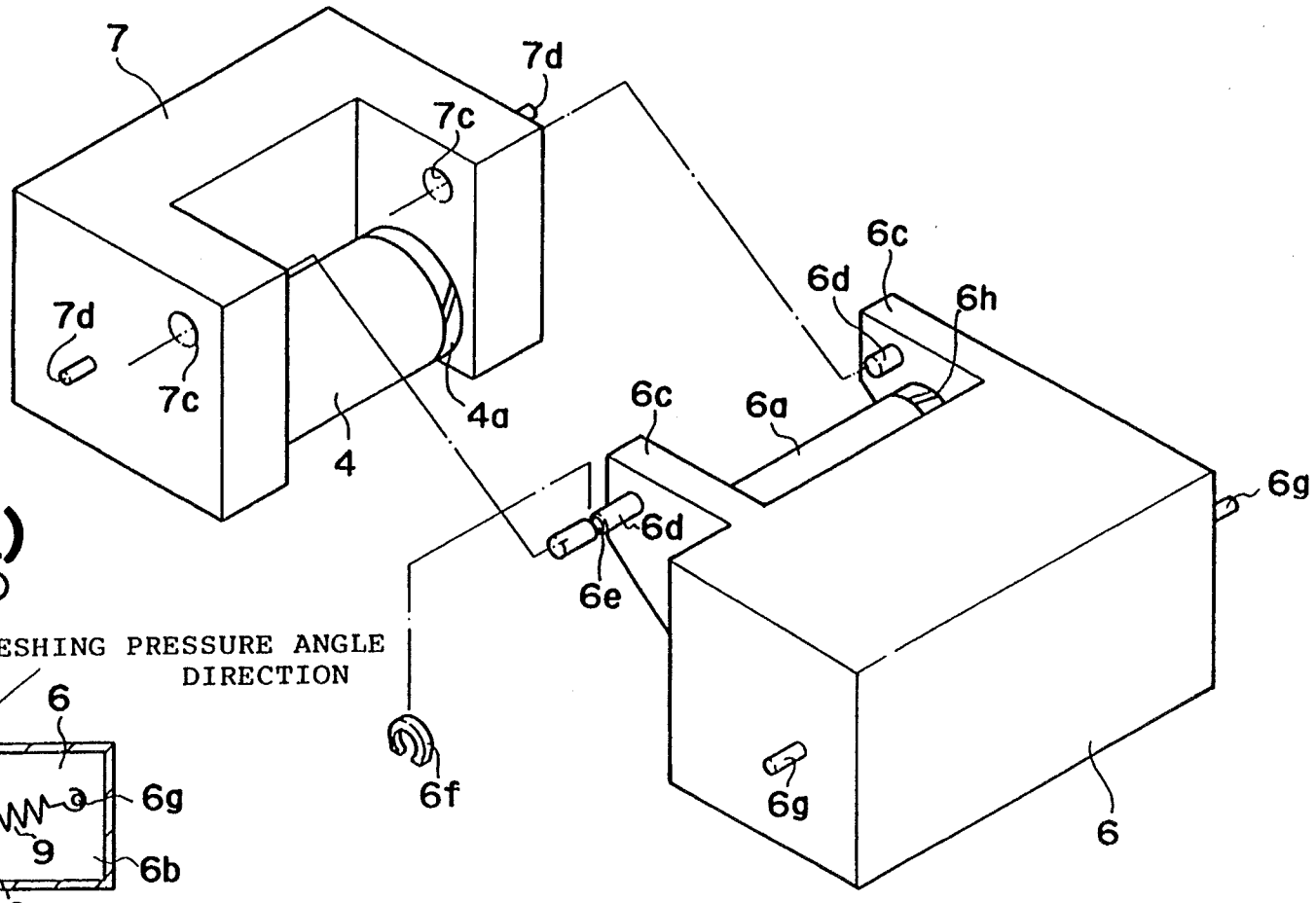
FIG. 1(b) (PRIOR ART)
FIGS. 1(*a*) and 1(*b*) are respectively a lateral cross-sectional view and a perspective view, showing the background art of the present invention.
Figure 1A:
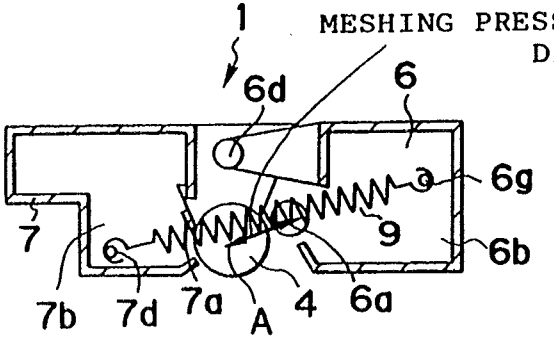
FIG. 1(a) (PRIOR ART)
Figures 2A, 2B, 2C:
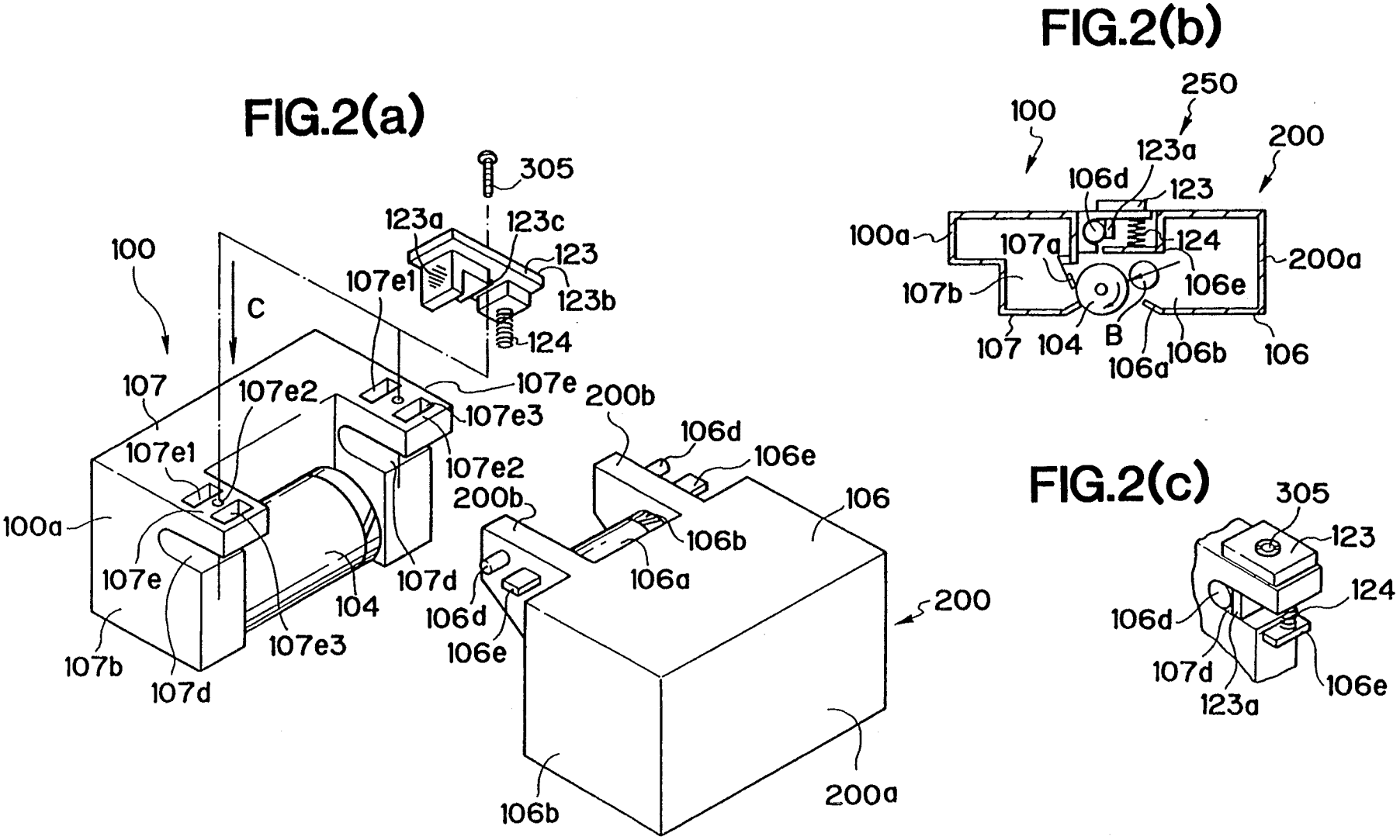
FIGS. 2(*a*), 2(*b*) and 2(*c*) are respectively a perspective view, a lateral cross-sectional view and a perspective view showing a combined state, of a preferred embodiment of the process cartridge of the present invention.

FIGS. 2(*a*) and 2(*b*) are respectively a schematic perspective view and a schematic cross-sectional view of a preferred embodiment of the process cartridge of the present invention. FIG. 2(*a*) illustrates a state in which a photosensitive drum unit 100 and a developing unit 200 are mutually disassembled.

In the present embodiment, a process cartridge 300 is constructed by coupling the photosensitive drum unit 100 and the developing unit 200. The photosensitive drum unit 100 rotatably supports an electro-photographic photosensitive drum 104 in a frame 100*a*, by means of bearings. It also is provided with a cleaning blade 107*a* and a used toner reservoir 107*b*, constituting a cleaner 107 for cleaning the periphery of the photosensitive drum 104. On the other hand, the developing unit 200 supports, in a frame 200*a*, a developing sleeve 106*a* and a toner reservoir 106*b*, constituting a developing device 106, wherein the developing sleeve 106*a* serves to transport the toner in the toner reservoir 106*b* to a developed area of the photosensitive drum 104.

In the following there will be explained a procedure for coupling the photosensitive drum unit 100 and the developing unit 200.

In the present embodiment, cylindrical projections 106*d*, formed on arms 200*b* of the developing unit 200 are fitted in U-shaped grooves 107*d* provided in the drum unit 100, and, after the fitting of the units 100, 200 in this manner, a stopper unit 123 in which a pressurizing spring (compression spring in this case) 124 is integrated (for example by snap fitting of an end of the compression spring) is fitted in a fixing part 107*e*, positioned above each of the U-shaped grooves 107*d*. Then the stopper unit 123 is fixed to the unit 100 by a screw 305 inserted in a direction c. In this operation, a face 123*a* of the stopper unit 123 and the U-shaped groove 107*d* define the position of the projection 106*d* of the developing unit 200, thereby limiting the position thereof. Also the pressure springs 124 press spring seats 106*e* of the developing unit 200, thereby applying a biasing force in a direction B of mutual impingement of the photosensitive drum 104 and the developing sleeve 106*a*.

The stopper unit 123 is integrally provided with a base plate 123*b*, a fixing screw hole 123*c* provided therein, a perpendicular plate 123*a* formed on said base plate 123*b*, and a compression spring 124.

On the other hand, the fixing part 107*e* formed in the drum unit 100 is provided with a hole 107*e*1 into which said perpendicular plate 123*a* is to be fitted, a female thread part 107*e*2 for fixing the screw 305, and a hole 107*e*3 for passing the spring 124.

Thus, after the projections (pins) 106*d* of the unit 200 are fitted in the deepest parts of the grooves 107*d* of the unit 100, the stopper units 123 are fixed on the fixed parts 107*e*. More specifically, the perpendicular plate 123*a* of the stopper unit 123 is fitted in the hole 107*e*1, while the spring 124 is made to pass through the hole 107*e* and to be received in a compressed state by the spring seat 106*e* of the unit 200, and the screw 305 is fixed, through the screw hole 123*c*, into the female thread part 1007*e*2.

In this manner the units 100 and 200 are coupled so as to be mutually rotatable about the pins 106*d*, thereby completing the process cartridge 250. The positional relationship between the periphery of the photosensitive drum 104 and that of the developing sleeve 106*a* is defined in thus coupled state of the units 100, 200, and the developing sleeve 106*a* is pressed toward the photosensitive drum 104 by the elastic force of the compression springs 124. (In the present embodiment, the elastic force of the compression springs is selected at about 2 kg, whereby a pressing force of about 1 kg is applied to the developing sleeve.)

A drum gear 104*a*, provided at a side of the photosensitive drum 104, meshes with a developing sleeve gear 106*b*, provided at a side of the developing sleeve 106*a*, thereby transmitting the rotating force, received from the main body of the printer, to the developing sleeve.

In the above-explained configuration, the developing unit 106 can be attached or detached in the direction of the U-shaped grooves 107*d*. Consequently the projections (pins) 106*d* can both be constructed outwards (or inwards), so that the thrust stopper can be dispensed with.

Also as the stopper unit 123 is inserted in the direction C and fixed in said direction, the pressurizing of the developing device can be realized simultaneously with the mounting of the stopper unit 123, and there is no longer required the conventional cumbersome operation of mounting the tension springs.

Also at the disassembling, the pressure is gradually released by loosening the stopper units, and the disassembling operation is extremely easy because of the absence of the thrust stopper.

Thus, the above-explained embodiment realizes the positioning of the developing device relative to the image bearing member, by means of a unit provided with compression springs, thereby improving the assembling and disassembling property of the process cartridge.

In the present embodiment, the photosensitive drum unit supports the cleaner, but such configuration is not essential. The process cartridge of the present invention needs only to be attachable to and detachable from the main apparatus in a state in which at least the photosensitive drum and the developing unit are integrally supported.

In the following, there will be explained another preferred embodiment of the present invention, with reference to FIGS. 3 to 7.

Figure 3:
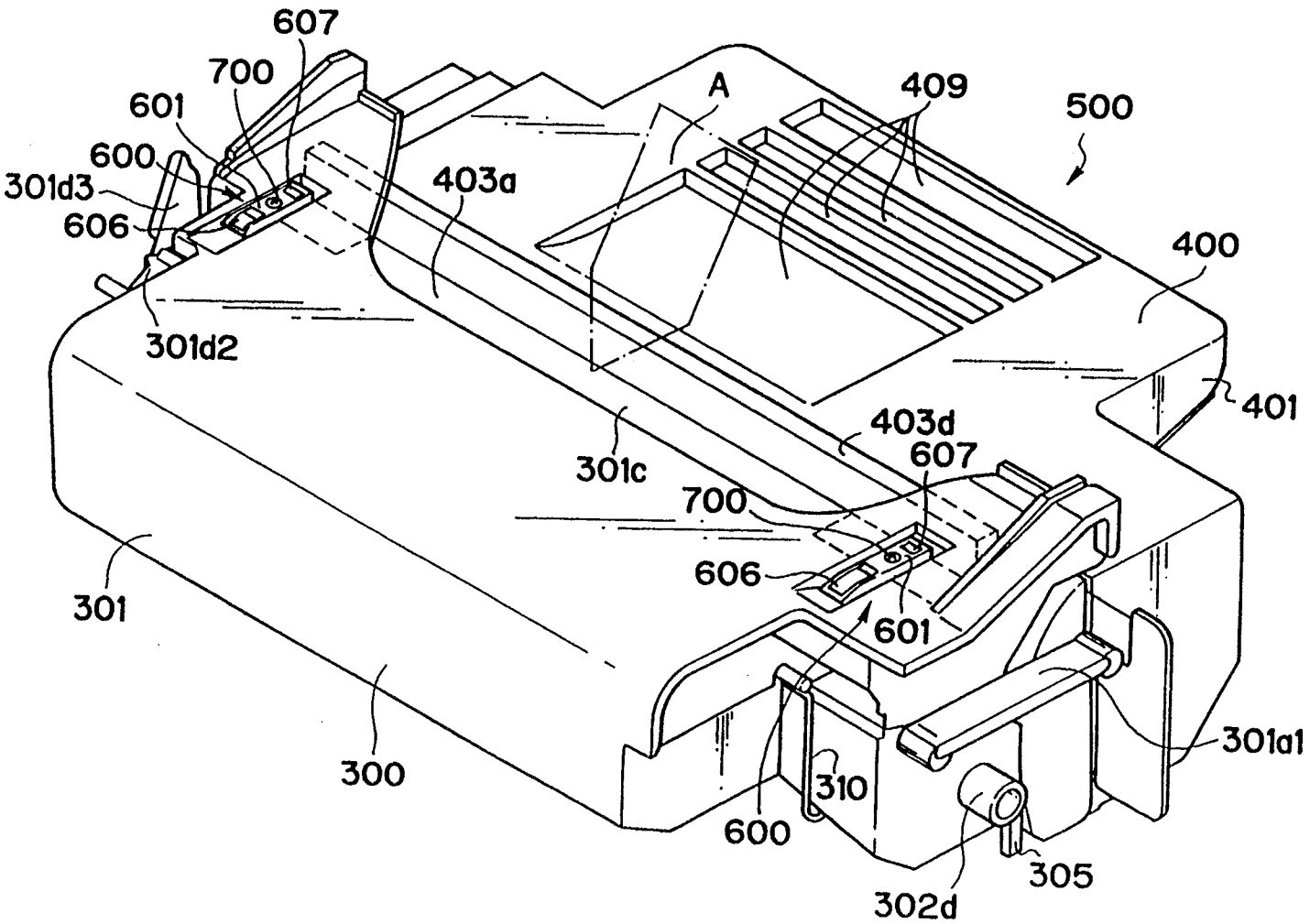
FIG. 3 is an external perspective view of a preferred embodiment of the process cartridge of the present invention.
Figure 4:
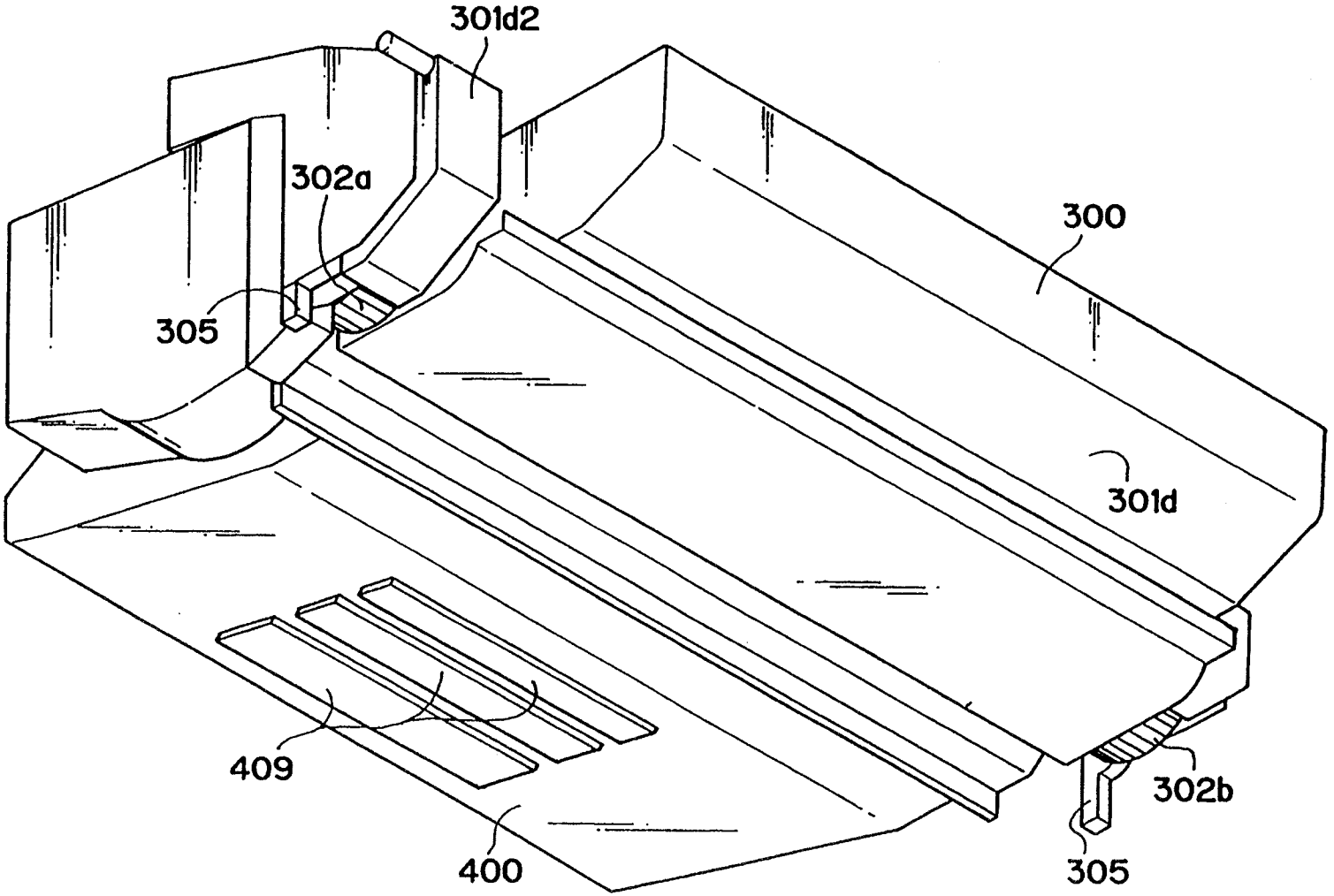
FIG. 4 is an external perspective view, seen from below, of the process cartridge, shown in FIG. 3.
Figure 5:
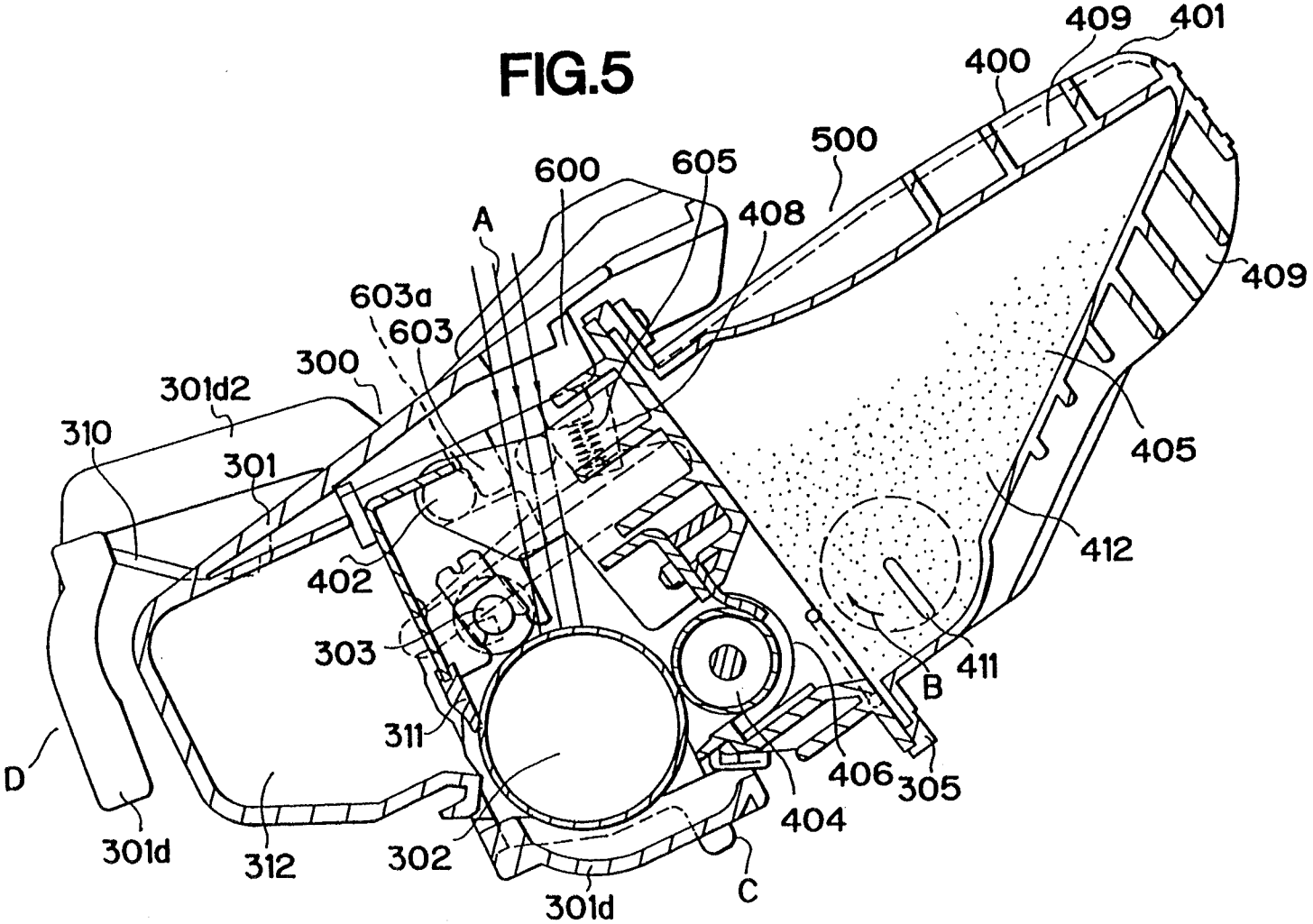
FIG. 5 is a lateral cross-sectional view of the process cartridge shown in FIG. 3.
Figure 6A:
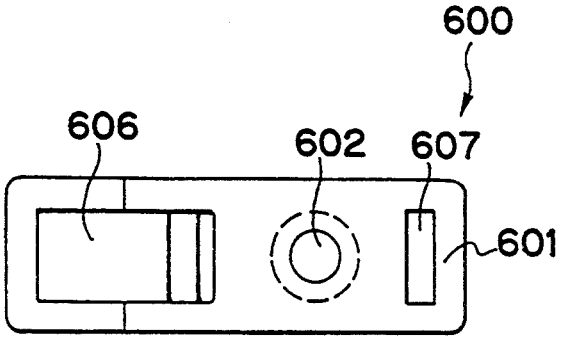
FIGS. 6(*a*) and 6(*b*) are respectively a plan view and a lateral view of an embodiment of coupling means adapted in the present invention.
Figure 6B:
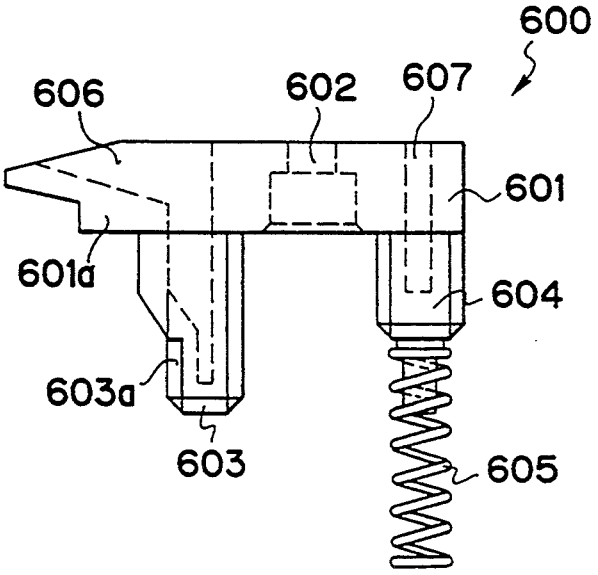
Figure 7A:
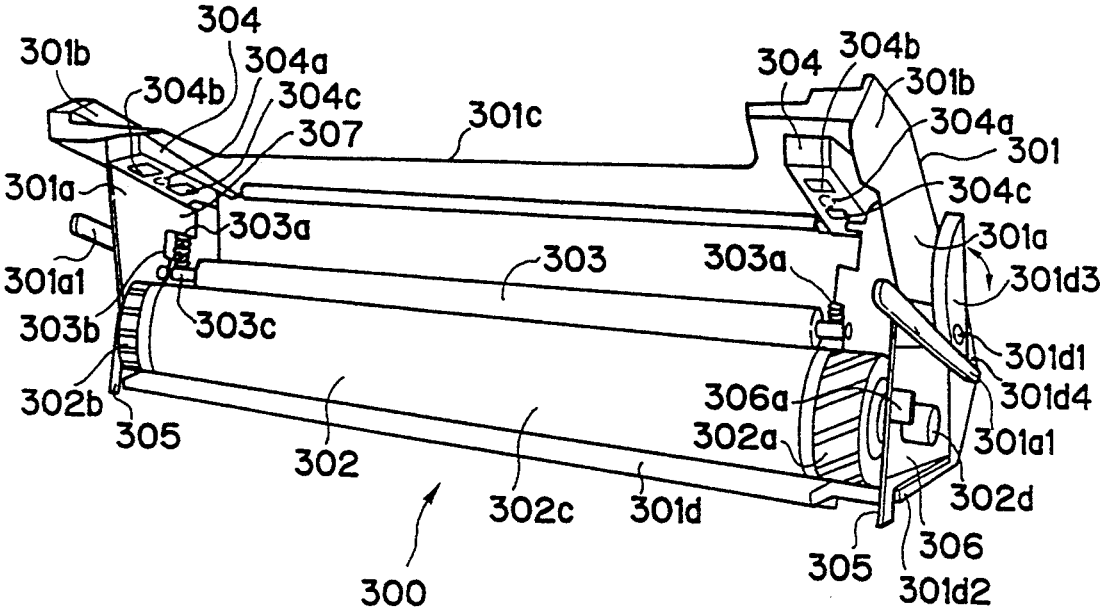
FIGS. 7(*a*) and 7(*b*) are perspective views respectively of a photosensitive drum unit and a developing unit, constituting the process cartridge shown in FIG. 3.
Figure 7B:
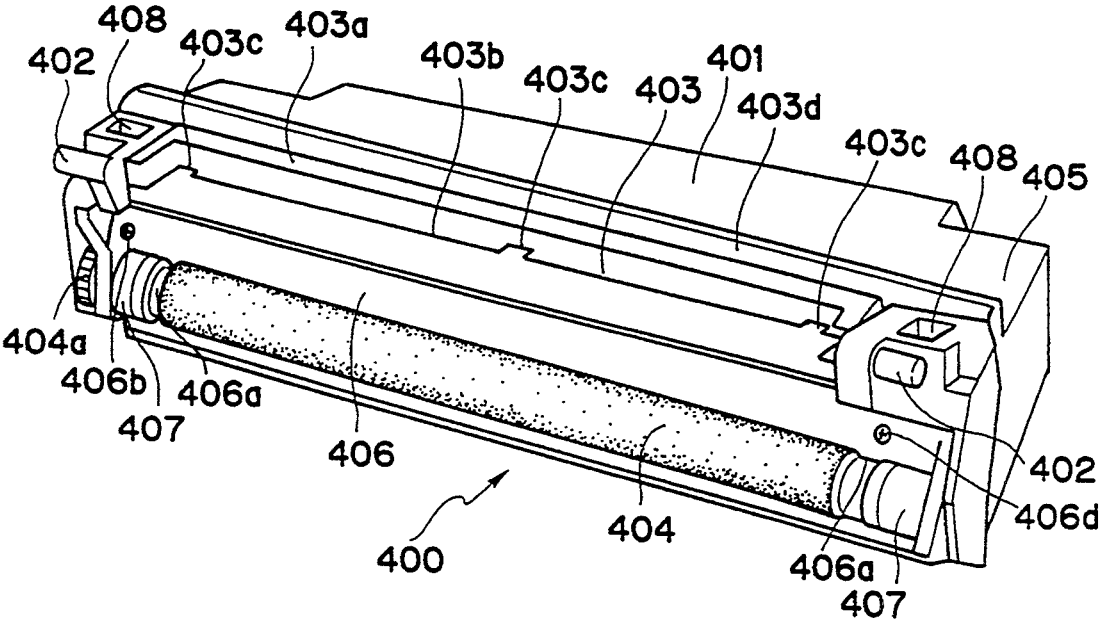

FIG. 3 is an external perspective view, seen from above, of a preferred embodiment of the process cartridge of the present invention, FIG. 4 is an external perspective view thereof seen from below, FIG. 5 is a lateral cross-sectional view of the process cartridge shown in FIG. 3, FIGS. 6(*a*) and 6(*b*) are respectively a plan view and a lateral view of an embodiment of the coupling means, and FIGS. 7(*a*) and 7(*b*) are perspective views respectively of a photosensitive drum unit and a developing unit, constituting the process cartridge shown in FIG. 3.

At first the photosensitive drum unit 300 will be explained with reference to FIG. 7(*a*).

A unit frame 301 is provided with attach/detaching guides 301*a*1 provided on the external faces of lateral plates 301*a*, upper arms 301*b* extending diagonally upwards, and an exposure aperture 301*c* positioned between said arms 301*b*. Said lateral plates 301*a*, guides 301*a*1, arms 301*b* and exposure aperture are integrally molded. Under said frame 301 there is openably provided a photosensitive drum protecting cover 301*d*. Said guides 301*a*1 serve to guide the process cartridge 500 in attaching to or detaching from the printer (to be explained later). Said exposure aperture 301*b* constitutes an exposure aperture in cooperation with a frame of a developing unit 400, when the process cartridge 500 is composed by coupling the photosensitive drum unit 300 and the developing unit 400. The protective cover 301*d* is mounted on an arm 301*d*2 rotatable about a shaft 301*d*1. It is retracted from a protecting position (illustrated) for protecting the periphery of the photosensitive drum to a retracted position, when an engaging part 301*d*3 integral with the arm 301*d*2 engages with an engaging part of the main body, and returns to said protecting position when said engaging parts are disengaged upon detachment of the cartridge 500 from the main body. In this manner the protective cover 301*d* is opened and closed, in response to the attachment and detachment of the cartridge.

Between the lateral plates 301*a*, a photosensitive drum 302 is rotatably supported by bearings. Said drum 302 is provided with a helical gear 302*a* at an end, a flat-tooth gear 302*b* at the other end, and an electrophotographic photosensitive member 302*c* (for example an amorphous photosensitive member of an organic photoconductor (OPC)) on the periphery. Upon attachment of the cartridge in the main body, said helical gear 302*a* meshes with a helical gear (not shown) of the main body, thereby receiving the drum driving force. Also when the units are coupled, said gear meshes with a developing sleeve gear of the developing unit 400, thereby transmitting the sleeve driving force. A conductive bearing 302*d* engages with a conductive part (not shown) of the main body, thereby grounding the drum 104.

A charging roller 303 is pressed, with a predetermined pressure, to the periphery of the drum 302, by means of springs 303*a*. An electrical contact spring 303*b* elastically contacts the shaft 303*c* of the charging roller 303, thereby applying a predetermined voltage from the main body to said ,charging roller 303.

In the present embodiment, in each of the arms 301*b* there is provided an elongated recess 304, including therein apertures 304*b*, 304*c* on both sides of a female thread part 304*a*. The front aperture 304*b* serves to pass a compression spring provided in a stopper unit to be explained later, while the rear aperture 304*c* serves to accept a perpendicular plate also provided in the stopper unit.

Below said recess 304, there is provided a rectangular groove 307, for accepting a pin of the developing unit 400 to be explained later.

Legs 305 serve to support the process cartridge 500 when it is detached from the main body. A conductive metal plate 305 is mounted on the lateral plate 301*a*, in contact with the bearing 302*d*, by means of a screw 306*a*.

In the following, explained is the developing unit 400, with reference to FIG. 7(*b*).

A unit frame 401 is provided, at upper lateral positions, with externally extending cylindrical pins 402, between which formed is an exposure aperture 403. There are also provided a light shield plate 403*a* for limiting the light other than from the exposure aperture 403, a rear light shield plate 403*b* for further limiting the light entering from the exposure aperture, with notches 403*c* at the center and at both ends in order not to hinder the image exposure, and a vertical light shield plate 403*e*. Said rear light shield plate 403*b* protrudes toward the photosensitive drum 302, beyond the light shield plate 403*a*.

Concave portions, e.g., rectangular grooves 408 are provided for receiving compression springs, to be positioned in the vicinity of circular pillar-like portions, e.g., the pins 402, as will be explained later.

A developing roller 404, constituting the developing means, transports by rotation the toner from a toner reservoir 405 to a developed portion of the photosensitive drum 302. A magnet roller is incorporated in said developing sleeve 404. A helical gear 404*a* receives the driving force by meshing with the drum gear 302*a* of the photosensitive drum unit 300 when the units 300, 400 are coupled to constitute the cartridge 500.

A doctor blade 406 is provided for limiting the thickness of toner on the periphery of the sleeve 404. On both ends, there are provided felt members 406*a* for preventing lateral leak of the toner. Outside areas 406*b* are free from toner deposition.

Plastic rollers 407 are provided on both ends of the sleeve 404, and have a diameter slightly larger than that of the sleeve 404. Consequently in the present embodiment, when the units 300, 400 are coupled to constitute the process cartridge 500, the periphery of the photosensitive drum 302 comes into contact with those of the rollers 407, thereby defining a small gap (for example 200–500$\mu$in the present embodiment) between the surfaces of the drum 302 and the sleeve 404. However such configuration is not essential, and said surfaces may be in direct contact. Screw 406*b* fix the blade 406 onto the frame 401.

In the following, there will be explained a stopper unit 600, serving as coupling means for coupling the units 300 and 400, with reference to FIGS. 6(*a*) and 6(*b*), which are respectively a plan view and a lateral view.

A screw hole 602, penetrating through a base member 601, accepts the male screw 700 (FIG. 3). A perpendicular plate 603 extends downwards from the lower face 601*a* of the base member 601, and serves to define the position of the pin 402 of the developing unit 400 by a lower lateral end 603*a*. A spring seat 604 is provided parallel to the perpendicular plate 603, and supports, at the end thereof, a compression spring 605 extending further downwards beyond the perpendicular plate 603. There are also provided hollow parts 606, 607.

The process cartridge 500 is assembled by coupling the units 300 and 400 in the following manner.

At first the photosensitive drum 302 of the unit 300 and the developing sleeve 404 of the unit 400 are positioned in mutually opposed manner, and the pins 402 on both sides of the unit 400 are inserted deeply into the rectangular grooves 307 on both sides of the unit 300, whereby the units 300 and 400 are mutually combined in such a manner that the arms 301*b* of the unit 300 cover the frame 401 of the unit 400.

Then, the stopper unit 600 is fitted into each of the recess 304. In this state, the front aperture 304*c* of the unit 300 faces the rectangular groove 408 of the unit 400, while the rear aperture 304*c* faces the rectangular groove 307. Thus the stopper unit 600 is fitted into the recess 304, by fitting the compression spring 605 through the front aperture 304*b* into the rectangular groove 408, and fitting the perpendicular plate 603 through the rear aperture 304*c*.

Subsequently, the male screw 700 is fixed to the female thread 304*a* through the screw hole 602 of the stopper unit 600, thereby fixing the stopper unit 600 to the unit 300. The assembly of the process cartridge 500 is thus completed (FIGS. 3 to 5).

Thus the pins 402 of the unit 400 are limited from movement by the lower lateral ends 603*a* of the perpendicular plates 603, whereby the units 300 and 400 are integrally coupled, with the pins 402 as the center of rotation. At the same time with the mounting of the stopper unit 600, the developing sleeve 404 is pressed by the elastic force of the compression springs 605, toward the periphery of the photosensitive drum 302. In the present embodiment, the peripheries of the drum 302 and the rollers 407 come into mutual contact, thereby defining the positions thereof. (In the present embodiment, a gap (for example about 200–500$\mu$) is formed between the peripheries of the drum 302 and the sleeve 404 in order to enable so-called jumping development, but these members may be in direct contact.)

Thus, the present embodiment can achieve the coupling of the photosensitive drum unit 300 and the developing unit 400 and the positioning of the photosensitive drum 302 and the developing sleeve 404 in a same assembling step, thereby shortening the assembling process.

Also in the present embodiment, when the units 300 and 400 are mutually coupled, the exposure aperture 301*c* of the unit 300 becomes positioned above the exposure aperture 403 of the unit 400, thereby defining an exposure aperture of a predetermined size (for introducing the image light from the main body of the printer). Thus, in the coupled state of the units 300 and 400, the frames 301, 401 cooperate each other to form the exposure aperture. The present embodiment can therefore improve the strength of the frames, as a large hole for image exposure need not be formed in one of the frames. Also the present embodiment can minimize the intrusion of unnecessary light from the exposure aperture, because of the presence of the light shield plate 403*a*, rear light shield plate 403*b* and vertical light shield plate 403*c* in the process cartridge 500.

In FIG. 3, an arrow A indicates the image exposing light. Parallel recesses 409, formed on the external surface of the frame 401 of the unit 400 serve as grips in the transportation of the cartridge 500 (said recesses 409 being omitted from illustration in FIG. 7(*b*)). Arms 310 support the protective cover 301*d*, at a side opposite to the side supported by the arms 301*d*2. FIG. 5 illustrates a new process cartridge 500 prior to use. In FIG. 5, there is provided a rotary blade 411, rotated in a direction B to feed the toner 412 toward the sleeve 404. An elastic cleaning blade 311, serving as the cleaner, is in contact with the periphery of the photosensitive drum 302, thereby removing the toner remaining thereon after the image transfer. A used toner reservoir 312 stores the toner scraped by the blade 311. C indicates the protecting position of the protective cover 301*d*, while D indicates the retracted position thereof. In this drawing, for facilitating the understanding, the protective cover 301*d* is illustrated in solid lines both in the protecting position C and in the retracted position D.

Figure 8:
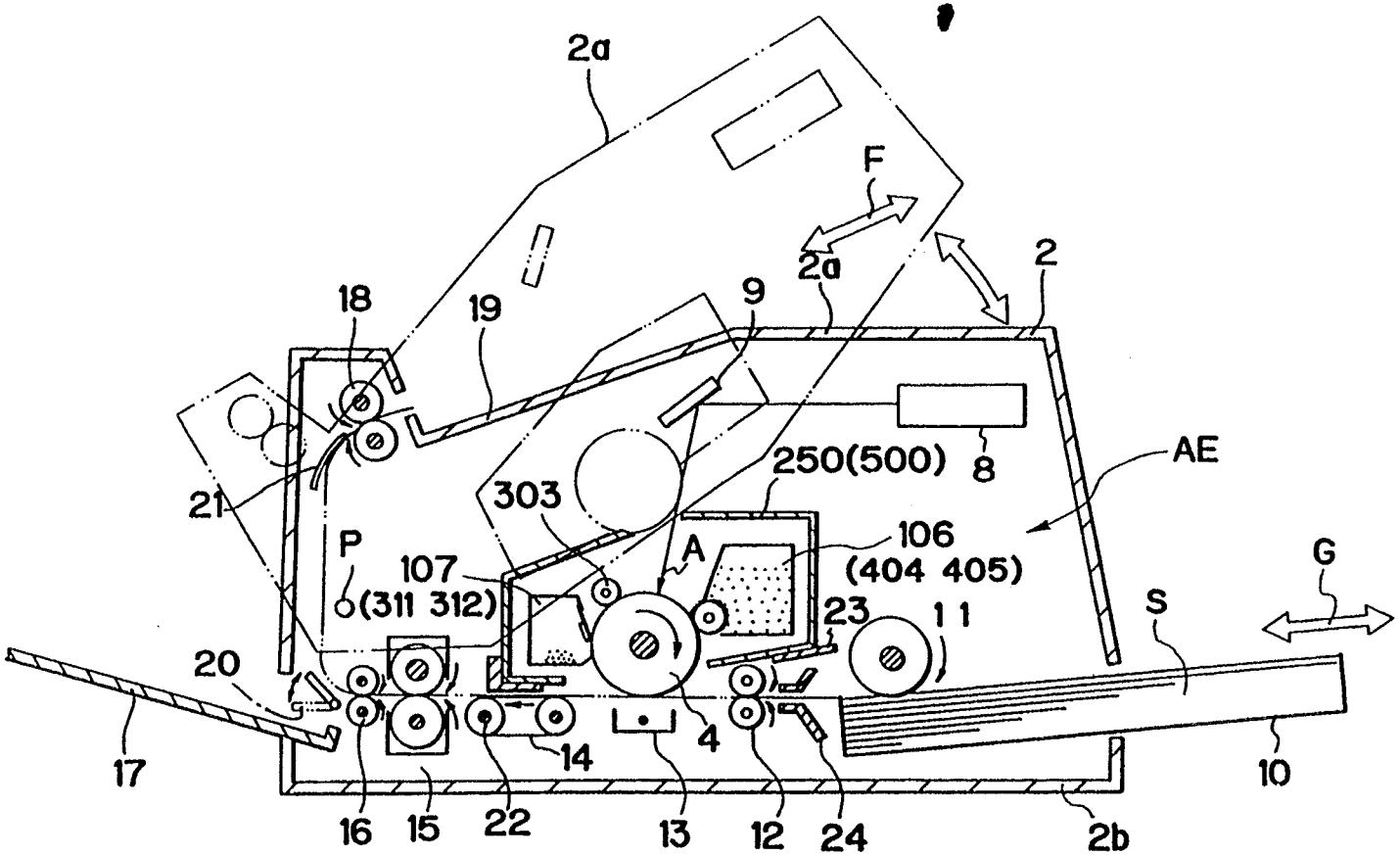
FIG. 8 is a lateral cross-sectional view of a laser beam printer in which the present invention is applicable.

Now reference is made to FIG. 8, for explaining a laser beam printer, in which the afore-mentioned process cartridge 250, 500 is detachably mounted. It is to be noted that, in FIG. 8, said process cartridge 250, 500 is only schematically illustrated.

As shown in FIG. 8, a laser beam printer 1 includes a process cartridge 250 (500) detachably mounted in a main body 2, and said process cartridge 250 (500) includes a photosensitive drum 104 (320) serving as the image bearing member, and process means such as a charger 303, a developing device 106 (404, 405 etc.), a cleaner 107 (311, 132) etc. positioned around said drum. In the upper part of the main body 2 there are provided a scanner unit 8 and a mirror 9 for emitting and guiding a laser beam.

The photosensitive drum 104 (302) uniformly charged by the charger 303 is irradiated by the laser beam, corresponding to the image information, from the unit 8 (indicated by arrow A), whereby a latent image corresponding to the image information is formed on the photosensitive drum 104 (302). Said latent image is developed into a toner image by the developing device 106 (404, 405 etc.). In the lower part of the main body 2, there is provided a sheet cassette 10 containing a plurality of sheets S servig as the recording medium (for example recording paper or overhead projector sheet). Next to the sheet cassette 10, there is provided a feed roller 11, which feeds the sheets S, one by one, from the cassette 10 to registration rollers 12. With a timing adjusted by the registration rollers 12, the sheet S is advanced to an image transfer position between the photosensitive drum 104 (302) and a transfer charger 13, and the toner image on said photosensitive drum 104 (302) is transferred, in said transfer position, onto the sheet S. After the toner image transfer, the sheet S is transported by a conveyor belt unit 14 to a fixing unit 15 for fixation of said toner image, and is discharged from the main body 2.

The laser beam printer of the present embodiment can select two methods in the discharge of the sheet S.

In the first face-up discharge method in which the sheets S are discharged with the image bearing faces thereof upwards, the sheet is discharged from face-up discharge rollers 16 onto a face-up discharge tray 17. In the second face-down discharge method in which the sheets S are discharged with the image bearing faces thereof downwards and in the order of pages, the sheet S is guided from said face-up discharge rollers 16 upwards through a transport direction switching mechanism such as a flapper 20 and a sheet guide member 21, thereby being inverted, and is discharged from face-down discharge rollers 18 onto a face-down discharge tray 19.

The maintenance works of the laser beam printer 1, such as the disposal of jammed sheet or replacement of the process cartridge 250 (500), are conducted by exposing the interior of the apparatus by rotating the upper part 2*a* of the main body 2 upwards about a shaft P, as indicated by chain lines, relative to the lower part 2*b*, and inserting a hand in a direction E.

Also, the attaching and detaching of the process cartridge 250 (500) are conducted in a direction F. More specifically, the cartridge 250 (500) is introduced into the main body 1 along the direction F, then is guided toward the mounting position, with the guides 301*a*1 of the cartridge guided by guide members (not shown) of the main body, and is supported in the mounting position by mounting means 22, 23. Subsequently the upper part 2*a* is rotated clockwise about the shaft P, whereby the apparatus becomes capable of image formation. With said clockwise rotation of the upper part 2*a*, an engaging part 301*d*3 of the protective cover 301*d* engages with an engaging part (not shown) of the main body, whereby the arms 301*d*2 are rotated anticlockwise to move the protective cover 301*d* to the retracted positon D. On the other hand, when the upper part 2*a* is opened by anticlockwise rotation, said engaging parts are disengaged whereby the protective cover 301*d* moves to the protecting position C by the elastic force of the springs 301*d*4.

24 indicates guide members. The sheet cassette 10 can be attached and detached in a direction G. The foregoing embodiments are not limitative, and the photosensitive drum unit needs only to contain at least the photosensitive drum, while the developing unit needs only to contain at least the developing device.

As explained in the foregoing, the present invention realizes to shorten the assembling process.

What is claimed is:

1. A process cartridge detachably mountable onto a main assembly of a recording apparatus, comprising:

a first support member supporting an image bearing member;

a second support member supporting development means for acting on said image bearing member to thereby develop a latent image of said image bearing member; and coupling means including a locking member for locking together said first and second support members rockably, and a compression spring for generating an elastic force between said image bearing member and said development means, adapted for coupling said first and second support members.

2. A process cartridge according to claim 1, wherein said coupling means is fixed by a screw to said first support member, and said first and second support members are coupled in mutually rotatable manner about a rotating shaft.

3. A process cartridge according to claim 1, wherein said image bearing member comprises a photosensitive drum, said development means comprises a developing sleeve, and the positions of the periphery of said photosensitive drum and of said developing sleeve are mutually defined in a state in which said first and second support members are coupled.

4. A process cartridge according to claim 1, wherein said image bearing member comprises an electrophotographic photosensitive member.

5. A process cartridge according to claim 1, wherein said image bearing member comprises an electrophotographic photosensitive member and said first support member is provided with charging means for charging said electrophotographic photosensitive member.

6. A process cartridge according to claim 1, wherein said image bearing member comprises an electrophotographic photosensitive member and said first support member is provided with cleaning means for cleaning said electrophotographic photosensitive member.

7. A process cartridge according to claim 1, wherein said first and second support members mutually cooperate, in the coupled state, to define an aperture for exposure.

8. A process cartridge according to claim 1, wherein said first support member is provided with a protective cover, which can be opened and closed, for protecting said image bearing member.

9. A process cartridge according to claim 8, wherein said protective cover is adapted to protect an image transfer area of said image bearing member.

10. A process cartridge according to one of claim 1 through 8, wherein said coupling means includes a base member, a screw hole allowing penetration of a screw member used for fastening said base member with said first support member, provided in said base member, a perpendicular plate formed as said locking member on said base member, and wherein said compression spring is provided on said base member.

11. A process cartridge according to claim 2, wherein said rotating shaft is composed of a cylindrical member fixed on said second support member.

12. A process cartridge according to one of claims 1 through 8, wherein said image bearing member comprises an electrophotographic photosensitive drum having a helical gear, for receiving a drive force from the main assembly, at a lateral end thereof.

13. A process cartridge according to claim 12, wherein said development means comprises a developing sleeve having a developing sleeve gear provided at a lateral end of said developing sleeve, and said helical gear meshes with said developing sleeve gear, thereby transmitting rotary driving force to said developing sleeve.

14. A process cartridge according to claim 1, wherein, said development means comprises a developing sleeve and said image bearing member comprises an electrophotographic photosensitive drum, and said developing sleeve of said developments means is urged toward said electrophotographic photosensitive drum of said image bearing member, by the elastic force of said compression spring.

15. A process cartridge according to claim 1, wherein said development means comprises a developing sleeve and said image bearing member comprises an electrophotographic photosensitive drum, and said developing sleeve of said development means and said electrophotographic photosensitive drum of said image bearing member are mutually pressed by the elastic force of said compression spring.

16. A process cartridge according to claim 1, wherein said development means comprises a developing sleeve and said image bearing member comprises an electrophotographic photosensitive drum, and said developing sleeve of said development means and said electrophotographic photosensitive drum of said image bearing member are arranged with a gap therebetween by the elastic force of said compression spring.

17. A process cartridge detachably mountable to a main assembly of a recording apparatus, comprising:

a first support member supporting an image bearing member;

a second support member supporting development means for acting on said image bearing member to thereby develop a latent image of said image bearing member; and coupling means including a defining member for defining the positions of said first and second support members, and a compression spring for generating an elastic force so as to bias said first and second support members closer, adapted for coupling said first and second support members.

18. A recording apparatus for recording on a recording medium, comprising:

mounting means for removably mounting a process cartridge including:

a first support member supporting an image bearing member;

a second support member supporting development means for acting on said image bearing member to thereby develop a latent image of said image bearing member; and coupling means including a locking member for locking together said first and second support members rockably, and a compression spring for generating an elastic force between said image bearing member and said development means, adapted for coupling said first and second support members; and transport means for transporting the recording medium.

19. A recording apparatus according to claim 18, wherein said recording apparatus is a laser beam printer.

20. A recording apparatus according to claim 18, wherein said recording apparatus is an electrophotographic copying apparatus.

21. A process cartridge according to claim 18, wherein said coupling means is fixed by a screw to said first support member, and said first and second support members are coupled in mutually rotatable manner about a rotary shaft.

22. A process cartridge according to claim 18, wherein said image bearing member comprises a photosensitive drum, said development means comprises a developing sleeve, and the positions of the periphery of said photosensitive drum and of the periphery of said developing sleeve are mutually defined in a state in which said first and second support members are coupled.

23. An assembling method for a process cartridge detachably mountable to a main assembly of a recording apparatus and including:

a first support member supporting an image bearing member;

a second support member supporting development means for acting on said image bearing member to thereby develop a latent image of said image bearing member; and coupling means including a locking member for locking together said first and second support members rockably, and a compression spring for generating an elastic force between said image bearing member and said development means, adapted for coupling said first and second support members, comprising a step of:

integrally coupling said first and second support members in a mutually rotatable manner about a rotary shaft, by means of said coupling means.

24. An assembling method according to claim 23, wherein said coupling means is fixed by a screw to said first support member, and said first and second support members are coupled in mutually rotatable manner about said rotary shaft.

25. An assembling method according to claim 23, wherein the positions of the periphery of a photosensitive drum serving as said image bearing member and of the periphery of a developing sleeve in said development means are mutually defined in a state in which said first and second support members are coupled.

26. An assembling method according to claim 23, wherein said coupling means includes a base member, a hole allowing penetration of a screw member used for fastening said coupling means with said first support member, provided in said base member, a perpendicular plate formed as said locking member on said base member, and said compression spring is provided on said base member.

27. An assembling method according to claim 23, wherein said rotary shaft is composed of a cylindrical member fixed on said second support member.

28. A process cartridge detachably mountable on a main body of a recording forming apparatus, said cartridge comprising:

a first frame supporting an image bearing member;

a second frame supporting developing means developing a latent image formed on said image bearing member; and connecting means for connecting said first frame to said second frame, said connecting means comprising a locking member and a compression spring for generating a resilient force in a direction to urge said image bearing member and said developing means together.

29. A process cartridge according to claim 28, wherein said connecting means is removably fastened to one of said frames by a screw member.

30. A process cartridge according to claim 28, wherein said connecting means comprises a base member, a protrusion forming the locking member provided on said base member, and a hole allowing penetration of a screw member used for fastening said connecting means with said first frame by fastening said connecting means with said first frame by fastening said base member to a frame, and wherein said compression spring is provided on said base member adjacent to said protrusion.

31. A process cartridge according to claim 30, wherein said protrusion locks a rocking shaft provided on said second frame to said first frame rockably, said compression spring urges said second frame in a direction so that said developing means approaches said image bearing member, and said base member is fastened to said first frame by a screw member via the screw hole.

32. A process cartridge according to one of claims 28, 30, and 31, wherein said image bearing member comprises a photosensitive drum and said cartridge further comprises a cleaning blade for scraping toner from said photosensitive drum, and a charge roller for electrically charging said photosensitive member.

33. A process cartridge according to claim 32, wherein said first frame has a shutter having a protection position for protecting said photosensitive drum and a retract position retracted from the protection position.

34. A process cartridge according to one of claims 28, 30, and 31, wherein said developing means comprises a developing roller and said second frame further supports a toner containing portion containing toner.

35. A process cartridge according to one of claims 28, 30, and 31 wherein said image bearing member comprises a photosensitive drum and said first frame further supports a cleaning blade and a charging roller, while said developing means comprises a developing roller and said second frame further supports a toner containing portion for containing toner.

36. A process cartridge according to claim 35, wherein said first frame and said second frame cooperate to form an exposure opening in a connected state wherein they are connected to each other by said connecting means, the exposure opening guiding an information light to said photosensitive drum.

37. A process cartridge according to claim 35, wherein a helical gear for receiving a drive force from the main body is provided at an end of said photosensitive drum to mesh with a helical gear provided at an end of said developing roller for transmitting a rotational drive force to said developing roller.

38. A process cartridge according to claim 28, wherein said first frame and said second frame are separable by disconnecting said connecting means.

39. A process cartridge according to claim 28, wherein said developing means comprises a developing roller having spacer rollers provided at both ends thereof and said image bearing member comprises a photosensitive drum and, in a state wherein said first frame and said second frame are connected by said connecting means, said spacer rollers are pressed onto said photosensitive drum, so that said photosensitive drum and said developing roller are positioned adjacent to each other with a predetermined gap therebetween.

40. A process cartridge according to claim 28, wherein said first frame overlaps said second frame to form an exposure opening for guiding an information light to said image bearing member.

41. A process cartridge according to claim 28, wherein said connecting means connects said first frame to said second frame rockably.

42. A recording apparatus for forming an image on a recording material, to which a process cartridge is detachably mountable, comprising:

mounting means for removably mounting said process cartridge, said process cartridge including a first frame supporting an image bearing member, a second frame supporting developing means for developing a latent image formed on said image bearing member; and connecting means is for locking said first frame to said second frame rockably having a locking member and a resilient member generating a resilient force in a direction so that said image bearing member and said developing means are urged together; and conveying means for conveying the recording material.

43. A recording apparatus according to claim 42, wherein a main body is said recording apparatus comprises a first body and a second body relatively openable, said mounting means being disposed in said first body and said first body having optical means for providing an information light to said image bearing member in said process cartridge mounted onto said mounting means.

44. An image forming apparatus according to claim 42, wherein said image forming apparatus comprises an electrophotographic copying machine.

45. A recording apparatus according to claim 42, wherein said image forming apparatus comprises a laser beam printer.

46. An assembling method for assembling a process cartridge detachably mountable onto a main body of a recording apparatus, comprising the steps of:

providing a first frame supporting an image bearing member;

providing a second frame supporting developing means for developing a latent image formed on said image bearing member;

providing connecting means for locking the first frame and the second frame rockably and having a locking member and a resilient member for generating a resilient force in a direction to urge the image bearing member and the developing means together; and connecting the first frame and the second frame integrally and rockably around a rotational shaft of the second frame using the connecting means.

47. A connecting method according to claim 46, wherein the resilient member includes a spring and the connecting means includes a base member, a protrusion providing on the base member being the locking member and the spring being provided on the base member adjacent to the protrusion, and a hole allowing penetration of a screw member used for fastening the connecting means with the first frame, for fastening the base member to a frame.

48. An assembling method according to claim 46 or 47, wherein said coupling step comprises releasably fastening the connecting means to the first frame by a screw member.

49. An assembling method according to claim 47, wherein said coupling step comprises locking a rotational shaft of the second frame to the first frame using the protrusion, and thereafter, fastening the base member to the first frame by a screw member penetrating the hole, whereby the first frame and the second frame are integrally connected rockably around the rotational shaft of the second frame.

50. An assembling method according to claim 47, wherein said coupling step comprises using the protrusion to lock a rotational shaft of the second frame to the first frame, so that the spring presses the second frame in a direction to urge a developing roller in the second frame toward a photosensitive drum in the first frame, and fastening the base member to the first frame by passing a screw member through the hole.

51. An assembling method according to one of claims 46, 47, 49, and 50, wherein said resilient member comprises a compression spring.

52. An assembling method according to claim 48, wherein said resilient member comprises a compression spring.

53. A developing frame used for a process cartridge detachably mountable onto a main body of a recording apparatus to be connected with a drum frame supporting a photosensitive drum, said developing frame comprising:

a supporting portion for supporting a developing roller for conveying a toner to a developing portion;

circular pillar-like connecting portions provided at both ends thereof above said supporting portion for forming a rotational center when said developing frame is connected to the drum frame; and concave portions provided at both ends thereof above said supporting portion adjacent to the respective circular pillar-like connecting portions, said concave portions being configured to receive a spring when said developing frame is connected to the drum frame.

54. A developing frame according to claim 53, wherein said developing frame and said drum frame are connected to each other by connecting means comprising a base member, a protrusion provided on said base member, a spring provided adjacent to the protrusion on said base member, and a hold allowing penetration of a screw member used for fastening said connecting means with said drum frame.

55. A developing frame according to claim 53 or 54, wherein said developing frame further comprises a developing roller having a magnet therein, a blade for regulating thickness of toner on a peripheral surface of said developing roller, and a helical gear provided at an end of said developing roller.

56. A developing frame according to claim 55, wherein said developing frame further comprises a toner containing portion for containing the toner.

57. A developing frame according to claim 55, wherein a spacer roller is provided at each end of said developing roller for abutting the peripheral surface of the photosensitive drum to form a gap between said developing roller and the photosensitive drum.

58. A developing frame according to claim 55, wherein at each end of said developing roller, a seal member for preventing the toner from leaking is disposed.

59. A drum frame used for a process cartridge detachably mounted onto a main body of a recording apparatus, and connected with a developing frame supporting developing means by connecting means, said drum frame comprising:

a supporting portion supporting a photosensitive drum, a first opening into, which a protrusion of the connecting means can be inserted, a second opening into which a spring of the connecting means can be inserted, and a hole portion for screwing a base member of the connecting means between the first opening and the second opening, the first and second openings and the hole portion being provided at both ends of said drum frame above said supporting portion.

60. A drum frame according to claim 59, wherein said drum frame further comprises an engaging portion whose one side is open to permit passage of a shaft of the developing frame to engage therewith, the protrusion of the connecting means preventing the shaft from disengaging from said engaging portion.

61. A drum frame according to claim 59, wherein said drum frame further comprises an attaching portion for a charging roller for charging said photosensitive drum, and an attaching portion for a cleaning blade for removing the toner from said photosensitive drum.

62. A drum frame according to one of claims 59 through 61 wherein the first opening, second opening, and hole portion are provided on an upper surface of said drum frame.

63. A process cartridge comprising a first frame and a second frame connected by connecting means and detachably mounted onto a main body of a recording apparatus, characterized by that:

said connecting means includes a base member, a protrusion provided on said base member, a spring provided on said base member adjacent to said protrusion, and a hole allowing penetration of a screw member used for fastening said base member to said first frame;

said first frame supports an electrophotographic photosensitive drum, and includes at both ends thereof above said electrophotographic photosensitive drum a first opening into which the protrusion of the connecting means can be inserted, a second opening into which the spring of the connecting means can be inserted, a screw portion having a hole, for fastening the screw member for screwing the base member of the connecting means using the screw member, between the first opening and the second opening, and an engaging portion whose one side is open to permit passage of a shaft of the second frame to engage therewith; and said second frame supports developing means for developing a latent image formed on said electrophotographic photosensitive drum, and having concave portion with a bottom surface for receiving the spring of the connecting means abutted at both ends thereof above said developing means, wherein the protrusion of said connecting means is inserted into the first opening so that said shaft of said second frame engaged with the engaging portion is held in place, and the base member of said connecting means is screwed with the screwing portion using the screw member, so that the spring of said connecting means is pressed into the concave portion of the second frame by inserting it through the second opening of said first frame overlapped over said second frame.

64. A process cartridge according to claim 63, wherein the electrophotographic photosensitive drum of said first frame and developing means of said second frame are urged by a resilient force of said spring in a direction toward each other.

65. A process cartridge according to claim 63 or 64, wherein said photosensitive drum and said developing means comprises a developing roller, said first frame further includes a charge roller for charging the photosensitive drum, a cleaning blade for removing the toner from the photosensitive drum, and a shutter shiftable to protect the photosensitive drum, while said second frame further includes a toner containing portion for containing the toner.

66. An assembling method for assembling a process cartridge detachably mountable onto a main body of a recording apparatus, and comprised of a first frame and a second frame connected to each other by connecting means, comprising the steps of:

providing a connecting means comprising a base member, a protrusion provided on the base member, a spring provided on the base member adjacent to the protrusion, and a hole allowing penetration of a screw member used for fastening the base member to the first frame;

providing a first frame for supporting an electrophotographic photosensitive drum and having at both ends thereof above the electrophotographic photosensitive drum a first opening into which the protrusion of the connecting means can be inserted, a second opening into which the spring of the connecting means can be inserted, a screwing portion, for screwing the base member of the connecting portion using the screw member, between the first opening and the second opening, and an engaging portion having one side open to permit passage of a shaft of the second frame to engage therewith;

providing a second frame for supporting developing means for developing a latent image formed on the electrophotographic photosensitive drum, and having at both ends thereof above the developing means a concave portion onto whose bottom surface the spring of said connecting means is abutted;

engaging a shaft of the second frame with the engaging portion;

inserting the protrusion of the connecting means into the first opening to prevent the shaft of the second frame engaged with the engaging portion from disengaging from the engaging portion;

inserting the spring of the connecting means into the second opening overlapped over the concave portion so that the spring is pressed into the one concave portion; and screwing the screw member into the screwing portion of the base member.

67. An assembling method according to claim 66, wherein the step for inserting the protrusion into the first opening, and the step for inserting the spring into the concave portion through the second opening are effected substantially simultaneously.

68. An assembling method according to claim 66, wherein the electrophotographic photosensitive drum of the first frame and the developing means of the second frame are urged in a direction toward each other.

69. An assembling method according to claims 66 or 67, wherein the developing means comprises a developing roller, and the first frame further includes a charging roller for charging the photosensitive drum, a cleaning blade for removing toner from the photosensitive drum, and a shutter shiftable for protecting the photosensitive drum, while the second frame further includes a developing roller as the developing means and a toner containing portion for containing the toner.

70. A developing frame used for a process cartridge detachably mountable onto a main body of a recording apparatus, and to be connected with a drum frame supporting an electrophotographic photosensitive drum by using connecting means, wherein said drum frame supports the photosensitive drum and has at both ends thereof above the photosensitive drum a first opening into which a protrusion of the connecting means can be inserted, a second opening into which a spring of the connecting means can be inserted, a screwing portion for screwing a base member of the connecting means between the first opening and the second opening, and an engaging portion where one side is open to permit a shaft of said developing frame to engage therewith, the connecting means having a base member, a protrusion provided on the base member, a spring provided on the base member adjacent to the protrusion, and a hole allowing penetration of a screw member used for fastening the base member to the frame by the screw member, characterized in that said developing frame supports a developing roller for developing a latent image formed on the photosensitive drum, and has at both ends thereof above the developing roller concave portions for receiving the spring of the connecting means, and a shaft forming a rocking center when said developing frame is connected with the drum frame, said shaft being disposed adjacent to the concave portions.

71. A developing frame according to claim 70, wherein the developing roller comprises at both ends thereof spacer rollers and has a magnet disposed therein.

72. A developing frame according to claim 70 or 71, wherein said developing frame comprises a developing blade for regulating toner amount on a peripheral surface of the developing roller, and a toner containing portion.

73. A drum frame used for a process cartridge detachably mountable onto a main body of a recording apparatus, and to be connected with a developing frame supporting a developing roller by using connecting means, wherein said developing frame supports a developing roller for developing a latent image formed on an electrophotographic photosensitive drum and having at both ends thereof above the developing roller concave portions for receiving a spring of a connecting means, the connecting means including a base member, a protrusion provided on the base member, a spring provided on the base member adjacent to the protrusion, and a hole allowing penetration of a screw member used for fastening the base member to the frame by the screw member, characterized in that said drum frame supports a photosensitive drum and includes at both ends of said drum frame, above the photosensitive drum, a first opening into which the protrusion of the connecting means can be inserted, a second opening into which the spring of the connecting means can be inserted, a screwing portion for screwing the base member of the connecting means between the first opening and the second opening, and an engaging portion whose one side is open to permit passage of a shaft of the developing frame to engage therewith.

74. A drum frame according to claim 73 wherein said drum frame further comprises a charging roller for charging the photosensitive drum, a cleaning blade for removing toner from the photosensitive drum, and a shutter shiftable for protecting the photosensitive drum.

75. A drum frame according to claim 73, wherein the photosensitive drum has a helical gear at one end thereof.

76. A drum frame according to claim 75, wherein said drum frame further comprises a charging roller for charging the photosensitive drum, a cleaning blade for removing toner from the photosensitive drum, and a shutter shiftable for protecting the photosensitive drum.

* * * * *

UNITED STATES PATENT AND TRADEMARK OFFICE

CERTIFICATE OF CORRECTION

PATENT NO. : 5,450,166 Page 1 of 4

DATED : September 12, 1995

INVENTOR(S) : Masahiko YASHIRO

It is certified that error appears in the above-indentified patent and that said Letters Patent is hereby corrected as shown below:

COLUMN 3:

Line 39, "to form" should be deleted.

COLUMN 4:

Line 68, "part 1007e2." should read --part 107e2.--.

COLUMN 6:

Line 42, "said ,charging" should read --said charging--.

COLUMN 7:

Line 5, "grooves 408" should read --grooves 408,--;

Line 29, "200-500μin" should read --200-500μ in--;

Line 32, "Screw 406*b*" should read --Screws 406*b*--;

Line 59, "recess 304." should read --recesses 304.--.

UNITED STATES PATENT AND TRADEMARK OFFICE

CERTIFICATE OF CORRECTION

PATENT NO. : 5,450,166

DATED : September 12, 1995

INVENTOR(S) : Masahiko YASHIRO

It is certified that error appears in the above-indentified patent and that said Letters Patent is hereby corrected as shown below:

COLUMN 10:

Line 20, "of" should read --on--;
Line 64, "claim" should read --claims--;
Line 66, "screw hole" should read --hole--.

COLUMN 11:

Line 23, "developments" should read --development--;
Line 49, "of" should read --on--;
Line 65, "of" should read --on--.

COLUMN 12:

Line 14, "process cartridge" should read --recording apparatus--;
Line 19, "process cartridge" should read --recording apparatus--.
Line 34, "of" should read --on--.

COLUMN 13:

Line 2, "forming" should be deleted.

UNITED STATES PATENT AND TRADEMARK OFFICE

CERTIFICATE OF CORRECTION

PATENT NO. : 5,450,166 Page 3 of 4

DATED : September 12, 1995

INVENTOR(S) : Masahiko YASHIRO

It is certified that error appears in the above-indentified patent and that said Letters Patent is hereby corrected as shown below:

COLUMN 14:

Line 29, "connecting means is for lock-" should read --¶ connecting means for lock- --;
Line 38, "is" should read --of--;
Line 45, "An image forming" should read --A recording--.

COLUMN 15:

Line 1, "A connecting" should read --An assembling--;
Line 4, "providing" should read --provided--;
Line 60, "hold" should read --hole--.

COLUMN 16:

Line 19, "into," should read --into--;
Line 40, "61" should read --61,--.

UNITED STATES PATENT AND TRADEMARK OFFICE

CERTIFICATE OF CORRECTION

PATENT NO. : 5,450,166 Page 4 of 4

DATED : September 12, 1995

INVENTOR(S) : Masahiko YASHIRO

It is certified that error appears in the above-indentified patent and that said Letters Patent is hereby corrected as shown below:

COLUMN 17:

Line 1, "portion" should read --portions--;
Line 20, "photosensitive drum and said" should be deleted.

COLUMN 20:

Line 1, "claim 73" should read --claim 73,--.

Signed and Sealed this

Twenty-eighth Day of May, 1996

*Attest:*

Bruce Lehman

BRUCE LEHMAN

*Attesting Officer*

*Commissioner of Patents and Trademarks*